US010384443B2

(12) United States Patent
Voina et al.

(10) Patent No.: US 10,384,443 B2
(45) Date of Patent: Aug. 20, 2019

(54) FLAT BED PRINTER

(71) Applicant: Océ Holding B.V., Venlo (NL)

(72) Inventors: Daniel-Samuil Voina, Timisoara (RO); Violeta Iacob, Timisoara (RO)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/593,588

(22) Filed: May 12, 2017

(65) Prior Publication Data

US 2017/0334193 A1 Nov. 23, 2017

(30) Foreign Application Priority Data

May 20, 2016 (EP) ..... 16170556

(51) Int. Cl.
*B41J 29/38* (2006.01)
*B41J 2/045* (2006.01)
*B41J 3/28* (2006.01)

(52) U.S. Cl.
CPC ..... *B41J 2/04505* (2013.01); *B41J 2/04586* (2013.01); *B41J 3/28* (2013.01)

(58) Field of Classification Search
None
See application file for complete search history.

(56) References Cited

U.S. PATENT DOCUMENTS 5,477,246 A * 12/1995 Hirabayashi ..... B41J 2/04528 347/12
2002/0190191 A1 12/2002 Maurin et al.
2006/0059821 A1* 3/2006 Coghlan ..... B41M 3/008 52/455
2009/0271026 A1 10/2009 Lerisson et al.
2009/0303276 A1* 12/2009 Van De Wynckel ..... B41J 3/4078 347/19

(Continued)

FOREIGN PATENT DOCUMENTS

FR 2 894 318 A1 6/2007
KR 2004035149 A * 10/2002

(Continued)

OTHER PUBLICATIONS

Kim, Device for Detecting Obstacles in Front of Vehicle and Projecting Image, Calculated Distance and Estimated Time to Collision Onto Head-Up Display, Oct. 2002, KR (Year: 2002).*

*Primary Examiner* — Matthew Luu
*Assistant Examiner* — Tracey M McMillion
(74) *Attorney, Agent, or Firm* — Birch, Stewart, Kolasch & Birch, LLP

(57) ABSTRACT

A flat bed printer includes a flat bed, a print head assembly, a drive system arranged to move the print head assembly over the bed, a controller arranged to control operations of the print head assembly and the drive system, and an obstacle detection system arranged to detect obstacles in a region of movement of the print head assembly. The controller has a split-bed mode of operation in which the movements of the print head assembly are confined to only a part of the bed while another part of the bed is left idle, and the controller is arranged to calculate, when an obstacle is detected in the split-bed mode of operation, an expected time to collision after which the print head assembly will collide with the obstacle.

11 Claims, 5 Drawing Sheets

(56) References Cited

U.S. PATENT DOCUMENTS

| | | | | |
|---|---|---|---|---|
| 2014/0015898 | A1* | 1/2014 | Yamada | B41J 2/145 347/43 |
| 2014/0019005 | A1* | 1/2014 | Lee | G08G 1/166 701/36 |
| 2016/0094087 | A1* | 3/2016 | Satake | H02J 3/383 307/23 |
| 2016/0114604 | A1* | 4/2016 | Anzai | B41J 3/4078 347/16 |

FOREIGN PATENT DOCUMENTS

| | | | |
|---|---|---|---|
| WO | WO 2006/128849 | A2 | 12/2006 |
| WO | WO 2014/207007 | A1 | 12/2014 |

* cited by examiner

FLAT BED PRINTER

The present invention relates to a flat bed printer comprising a flat bed, a print head assembly, a drive system arranged to move the print head assembly over the bed, a controller arranged to control operations of the print head assembly and the drive system, and an obstacle detection system arranged to detect obstacles in a region of movement of the print head assembly.

A flat bed printer of this type has been described in WO 2014/207007 A1. The obstacle detection system serves for detecting the presence of any obstacles in the print area of the flat bed or in the vicinity thereof, and when an obstacle is detected and, consequently, there is a risk that the print head assembly collides with the object, a warning may be issued so as to alert a user or operator in order to have the object removed. As an alternative, or in cases where the obstacle is not removed, the print operation may be stopped.

It is generally known that a flat bed printer may be operated in a split-bed mode in which the print head assembly scans only a certain part of the available print area, whereas an other part remains idle. This offers the possibility to print on a substrate with relatively small dimensions in the active part of the print area whereas the user may prepare a substrate for a subsequent print operation on the idle part of the print area.

It is an object of the present invention to provide a printer which can be operated safely and with high productivity in the split-bed mode.

In order to achieve this object, according to the present invention, the controller has a split-bed mode of operation in which the movements of the print head assembly are confined to only a part of the bed while another part of the bed is left idle, and the controller is arranged to calculate, when an obstacle is detected in the split-bed mode of operation, an expected time to collision after which the print head assembly will collide with the obstacle.

Thus, in the printer according to the present invention, an action in order to avoid a collision of the print head assembly with an obstacle is not necessarily taken whenever an obstacle is detected. Instead, whether or not an action is taken and what action is taken will depend upon the calculated time to collision. This permits a user or operator to work at the idle part of the flat bed without causing an interruption of the print process on the active part of the bed. For example, as long as an obstacle is detected only in the area of the idle part of the bed, which part is not scanned by the print head assembly, there is no risk of collision, and the time to collision will accordingly be infinite, so that no action needs to be taken. Even when the user moves a hand or a tool into the active area of the bed, there will be no risk of collision as long as the print head assembly is moving away from the obstacle constituted by the tool or the hand of the user, and the print operation may be maintained at least for a while. Only when the print head assembly changes direction and approaches the obstacle, the calculated time to collision will lead to an appropriate anti-collision action.

More specific optional features of the present invention are indicated in the dependent claims.

The obstacle detection system may comprise any suitable kind of sensors or sensor combinations, including 2D or 3D cameras in conjunction with image recognition software, infrared emitter-sensors (e.g. LIDAR), radar sensors or electrostatic sensors, sensors such as Bluetooth beacons or the like for detecting a wrist watch or other wearables of the user, sensors for detecting a foot position of an operator, e.g.

a pressure sensitive carpet in the environment of the printer, and many more. The obstacle detection system may also be capable of detecting a movement of the obstacle, and then the calculation of the time to collision may be based upon an extrapolation of the detected movement of the obstacle.

The controller does not necessarily have to be implemented in the printer itself but may also be an external computer or a mobile control device such as a smartphone or the like having an App for controlling the printer.

The anti-collision actions to be taken when an obstacle is detected may comprise issuing a warning signal, e.g. an acoustic signal, when the time to collision is smaller than a certain threshold value, stopping the print operation, or slowing down the movement of the print head assembly in order to extend the time to collision and to provide more time for removing the obstacle.

The print head assembly may comprise a gantry and a print head, the print head being movable relative to the gantry in a main scanning direction and the gantry being movable relative to the bed in a sub-scanning direction orthogonal to the main scanning direction.

In that case, an obstacle may collide with the gantry and/or with the print head, and separate times to collisions may be calculated for these two types of event. Naturally, the shorter of these two times to collision will be decisive for the action to be taken.

When the action comprises slowing down the movement of at least one component of the print head assembly, it is desired to avoid that the change in the speed of the print head or gantry leads to any artefacts in the printed image. Typically, the gantry is moved step-wise in the sub-scanning direction, which facilitates to avoid artefacts being caused by changes in the average speed of the gantry, e.g. changes in the step width and/or the step frequency. In contrast, the print head typically performs a reciprocating continuous movement along the gantry, so that speed changes can more likely lead to artefacts. It is therefore preferred to control the length of the pauses at the points where the print head changes direction and therefore its speed is zero. Depending upon the time to collision, it may however be necessary to make an "emergency stop" while the print head performs a scan pass. In that case, a strategy for avoiding artefacts may comprise gradually fading out the printed image before the movement of the print head stops. Then, the missing pixels will be inserted in the image when the print process is resumed, so that, in a certain transition zone, the printed image will be a blend of two interleaved sub images which have been printed before and after the print head stop, respectively.

The invention also relates to a software product comprising program code on a non-transitory machine-readable storage medium, the program code, when run on a controller of a flat bed printer, causing the controller to perform the method according to the invention.

Embodiment examples will now be described in conjunction with the drawings, wherein.

Figure 1:
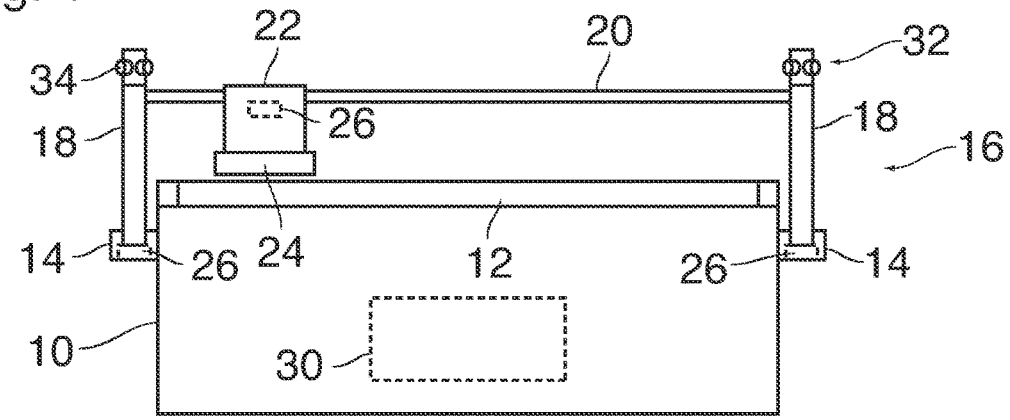
FIG. 1 is a view of flat bed printer according to the present invention.

As is shown in FIG. 1, a flat bed printer comprises a frame 10 with a flat bed 12 mounted on a top side of the frame. The bed 12 has a flat top surface which serves for supporting and securing a print substrate (not shown in FIG. 1), e.g. a media sheet or a substrate on which a 2D object or a 3D object shall be printed. For example, the flat bed 12 may be formed by a suction plate having a perforated top surface and suction means for drawing-in air through the perforations in order to fix the print substrate.

Guide rails 14 are mounted on both sides of the frame 10 and a gantry 16 is guided and driven for movement along the guide rails 14. In the example shown, the gantry 16 has two vertical posts 18 each of which is guided in one of the guide rails 14 and which are interconnected by a guide rail 20 that extends across the bed 12. A print head carriage 22 is guided and driven for movement along the guide rail 20, and a print head 24, e.g. an ink jet print head, is mounted on the bottom side of the carriage 22 and has a plurality of ink-ejecting nozzles (not shown) in a bottom surface facing the top surface of the bed 12. Components of a drive system 26 for moving the carriage 22 along the guide rail 20 and moving the posts 18 along the guide rails 14 are mounted in the carriage 22 and in the guide rails 14, respectively, in this example and are controlled by an electronic controller 30. The controller 30 is also connected to the print head 24 for controlling the operations of actuators (not shown) for expelling ink droplets from the nozzles of the print head in order to form an image on the print substrate on the bed 12.

An obstacle detection system 32 is provided for detecting the presence of any possible obstacles on the bed 12 or in the vicinity thereof. In the example shown, the obstacle detection system is incorporated in upward extensions of the vertical posts 18 and comprises a set of four digital cameras 34 in each extension, and image recognition software loaded in the controller 30.

Figure 2:
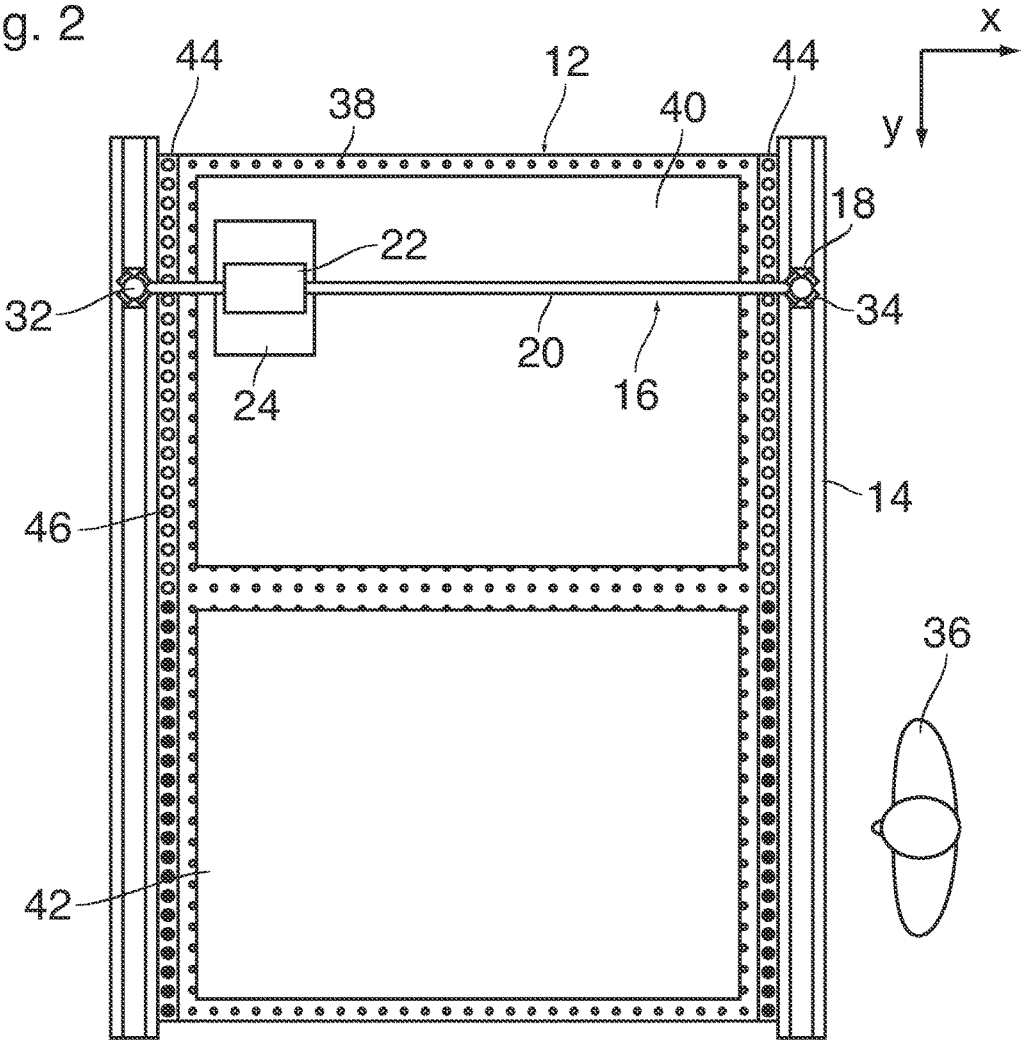
FIG. 2 is a top plan view of the printer shown in FIG. 1.

As is shown more clearly in FIG. 2, the cameras 34 on each post 18 are arranged at equal angular intervals so as to supervise the entire space on and above the bed 12 as well as the immediate surroundings of the printer. Thus, the obstacle detection system 32 can for example detect the presence of an operator 36 near the printer.

FIG. 2 also shows suction holes 38 in the top surface of the suction plate forming the bed 12, most of these suctions holes being covered by two sheet-like print substrates 40, 42 which have been placed side-by-side on the bed 12.

The controller 30 has control software which enables it to operate among others in a split-bed mode in which the bed 12 of the printer is split into an active part and an idle part and the scan movements of the gantry 16 and the print head 24 are confined to the active part. In the example shown in FIG. 2, the active part of the bed 12 is constituted by the upper half which supports the print substrate 40, whereas the operator 36 is just about to position the print substrate 42 in the idle part. In the example shown, two LED lines 44 are disposed along the longer sides of the bed 12, and LEDs 46 in these LED lines can be switched on and off for visualizing the extension of the active part and the idle part, respectively, of the bed.

By way of example, it shall now be assumed that the printer is busy with printing an image on the substrate 40 in the split-bed mode, while the operator 36 works at the idle part of the bed in order to prepare the sheet 42 for a subsequent print operation. The operator 36 may manipulate the print substrate 14 as well as tools, such as alignment tools or the like, with his hands, and he may also place some objects, such as fixtures or jigs, on the print substrate 42 and the bed 12, respectively. It is possible that the operator 36 inadvertently enters into the area of the active part of the bed 12 with his hands or other parts of his body or places objects on the active part of the bed. In this case, the parts of the body and the objects, respectively, may constitute obstacles that may collide with a gantry 16 and the print head 24, respectively.

Figure 3:
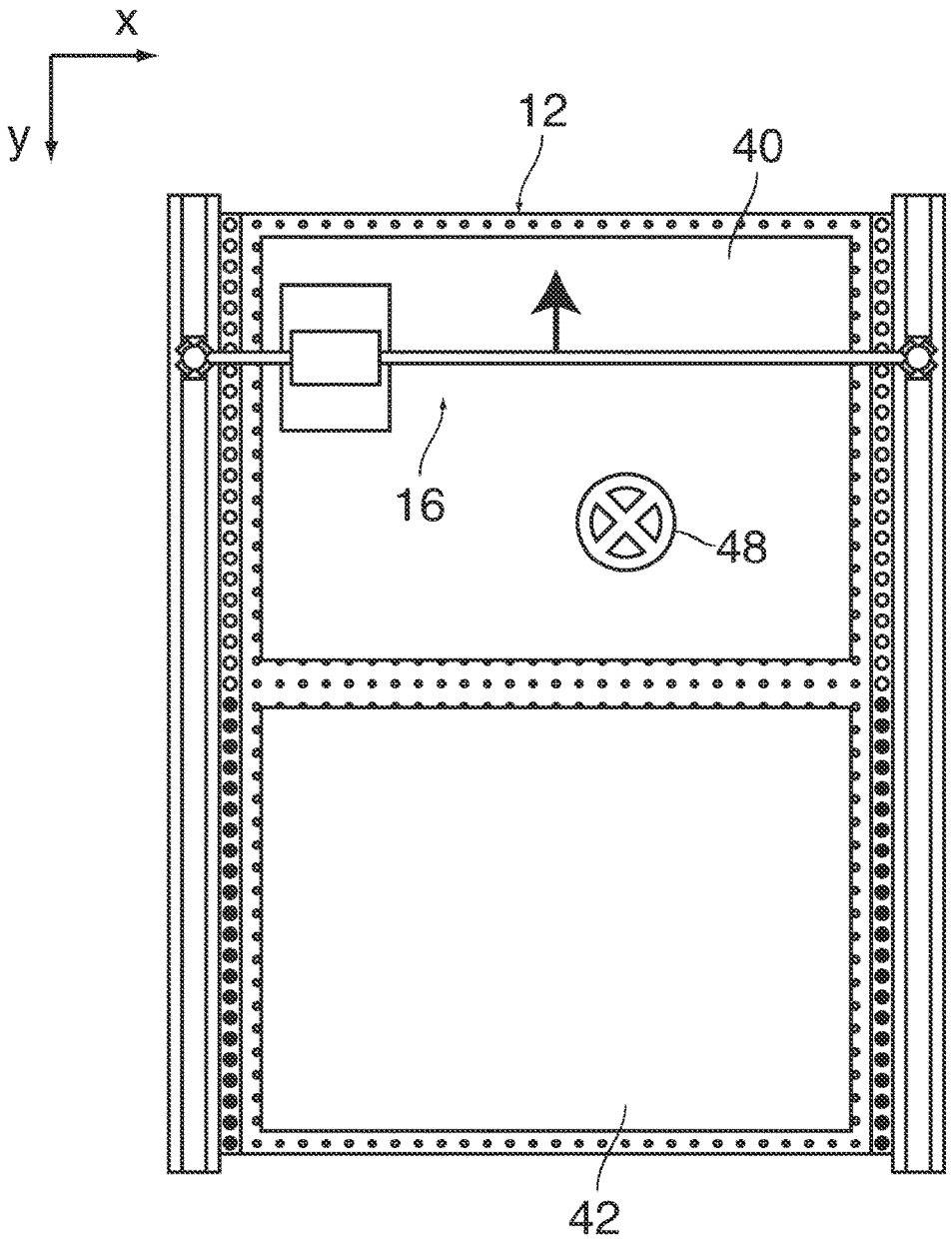
FIG. 3 is a view corresponding to FIG. 2, illustrating a condition in which an obstacle is present on the bed of the flat bed printer.

FIG. 3 illustrates a situation where an obstacle 48 (shown symbolically) is present on the bed 12 while the gantry 16 moves in a sub-scanning direction −y away from the idle part of the bed 12 supporting the print substrate 42, and away from the obstacle 48. In this case, a collision of the gantry 16 with the obstacle 44 will definitely not occur before the gantry has completed its path of travel in the direction −y and has returned and started to move in the opposite direction. A "time to collision" may nevertheless be calculated on the basis of a scheduled movement of the gantry 16 and the detected position of the obstacle 44. However, this time to collision will be so large that no immediate action needs to be taken even though an obstacle has been detected.

Figure 4:
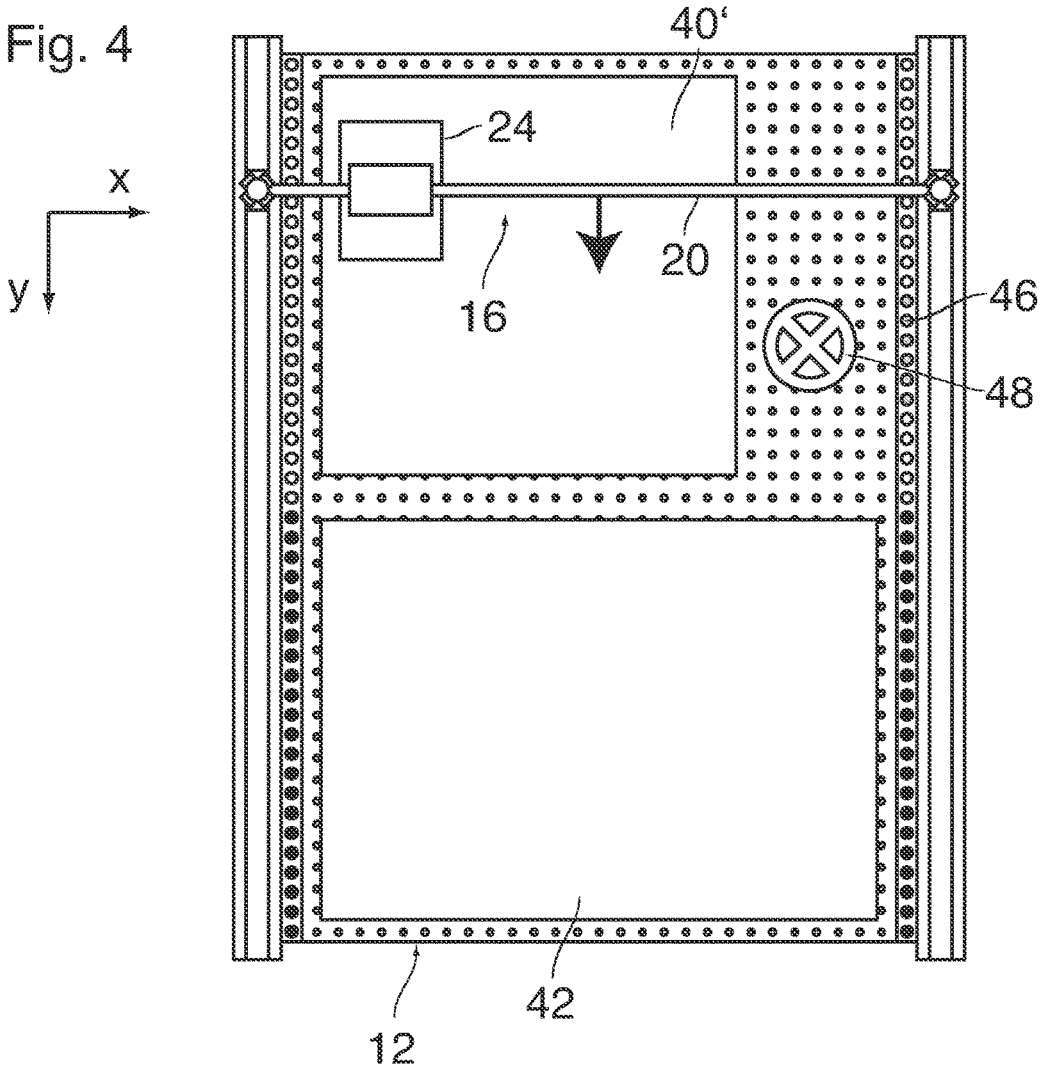
FIG. 4 illustrates an example of another condition where an obstacle is present on the bed of the printer.

FIG. 4 illustrates a situation where the gantry 16 moves in the opposite direction +y while the print head 24 reciprocates in the main scanning directions +x and −x in order to print an image on a substrate 40'. It is observed however that the substrate 40' does not cover the entire width of the bed 12. The obstacle 48 is in this case detected in a position within the range of the substrate 40' in the sub-scanning direction but outside of the area of the print substrate 40' in the main scanning direction. Since the range of movement of the print head 24 is confined to the area of the substrate 40', there will be no collision between the print head 24 and the obstacle 48. There may however occur a collision between the obstacle 48 and the guide rail 20 of the gantry 16. The time to collision will be smaller than in the case illustrated in FIG. 3.

In the situation shown in FIG. 4, it will therefore be appropriate to issue a warning signal in order to cause the operator to remove the obstacle 48 well before expiry of the expected time to collision. For example, an acoustic warning signal may be issued, possibly accompanied by blinking of the electrodes 46 in the critical range of the bed 12.

Another useful action may be to slow down the movement of the gantry 16 in the direction +y in order to extend the time to collision and thereby increase the probability that the obstacle 48 will be removed in time.

It will be observed that the gantry 16 moves step-wise in the sub-scanning direction in order to move the print head 24 over a certain step width in the direction +y each time the print head has completed a scan pass in the main scanning direction ±x. Thus, slowing down the movement of the gantry 16 may be achieved by keeping the speed of the print head 24 in the main scanning direction constant until the end of a scan pass is reached and then pausing the print head for a certain time and delaying the time at which the gantry 16 is advanced in the sub-scanning direction. Another possibility is to reduce the step width of the gantry in the sub-scanning direction +y. In that case, in the subsequent scan pass some of the nozzles of the print head 24 will move over a part of the substrate 40' which has been printed already, so that these nozzles should be kept silent. This latter option of slowing down the movement of the gantry 16 is preferred, because it assures, especially in case of printing with slow-drying inks, that the time intervals between two subsequent scan passes are equal, so that the ink dots will always have the same time to dry out before a dot is printed in a neighboring pixel position in the next scan pass. This will reduce the likelihood that the change in the average speed of the gantry 16 leads to artefacts in the printed image.

Figure 5:
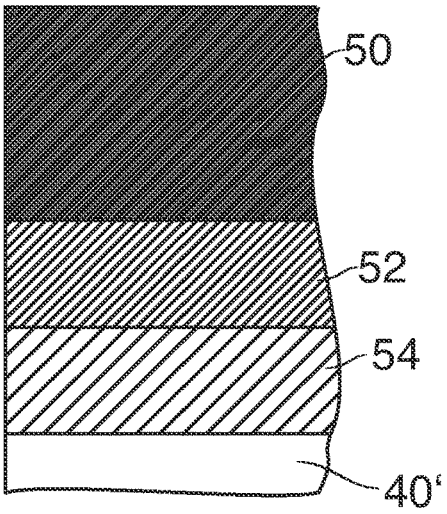
FIGS. 5 and 6 illustrate different patterns of multi-pass printing which may be applied depending upon the detection of an obstacle on the flat bed.

FIG. 5 shows a part of the print substrate 40' and illustrates a three-pass print mode with normal speed of advance of the gantry 16. A part 50 of the printed image has been completed already in three subsequent scan passes. For an adjacent swath 52 of the image, only two scan passes have been performed so far, so that the image density is lower because about one third of the pixels have not yet been printed and will be inserted only in the next scan pass. In yet another swath 54, only one scan pass has been completed, and the rest of the print substrate is still empty. The step width of the movement of the gantry 16 in the sub-scanning direction corresponds to the width of each of a swathes 52, 54.

Figure 6:
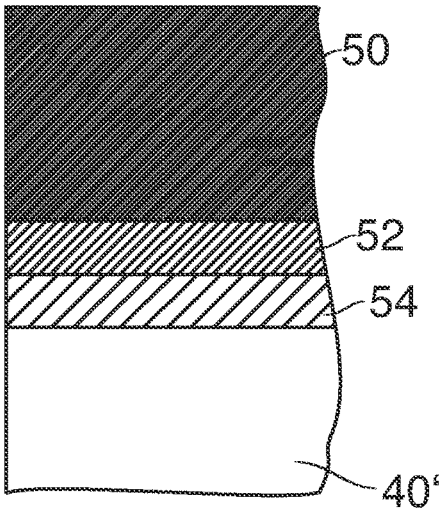

FIG. 6 shows the result of the same print operation for the case that the movement of the gantry 16 in the sub-scanning direction has been slowed-down to one half by reducing the step width.

In the mode shown in FIG. 6, the time to collision will be extended. If the obstacle 48 is not removed, the controller 30 may decide to interrupt the print process before a collision with the obstacle occurs. The latest moment at which the print process can be stopped safely without creating any artefacts will be the end of the last scan pass before the guide rail 20 would hit the obstacle 48. The time to collision would then be smaller than a certain threshold value which correspond to the step width of the gantry movement (width of the swathes 52 and 54 in FIG. 6), divided by the speed of the gantry during the advance step. Thus, the print process will be stopped when the print head 24 has completed a scan pass and the remaining time to collision is smaller than that threshold value.

Figure 7:
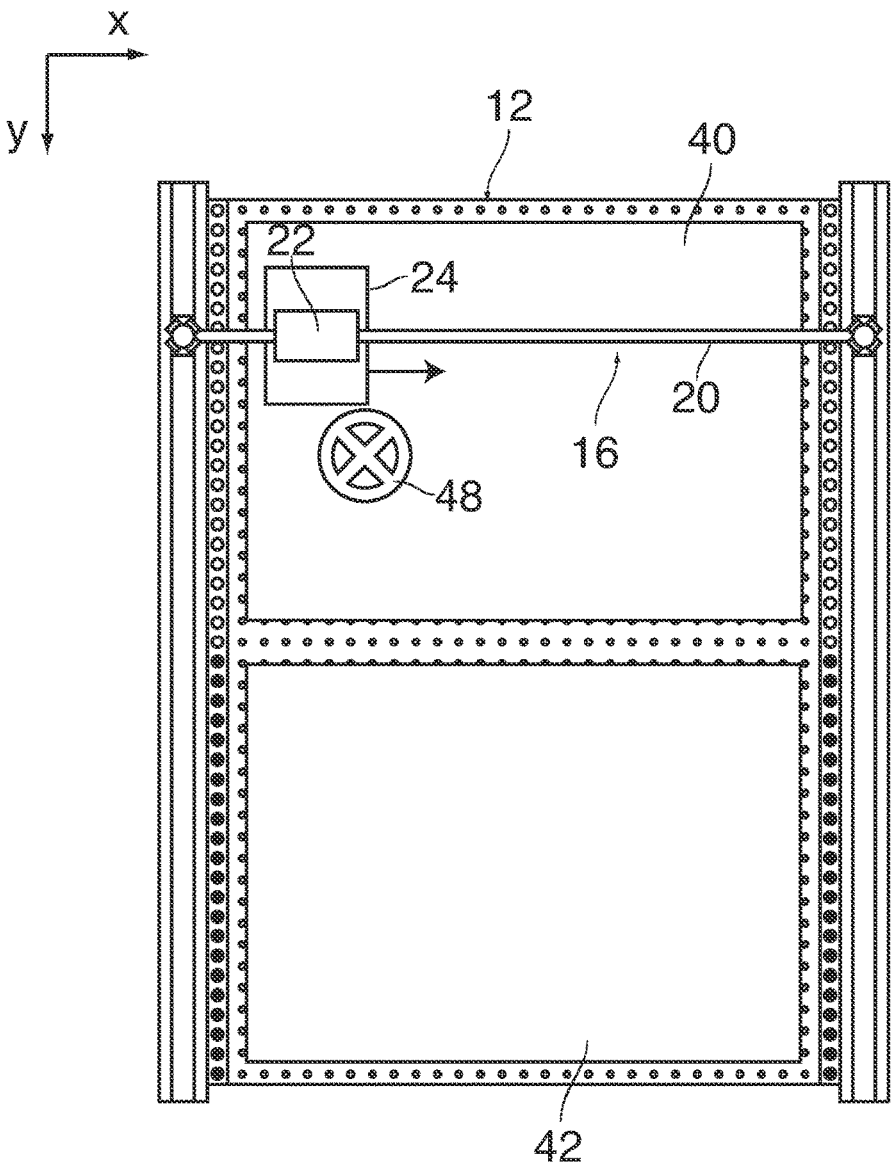
FIGS. 7 and 8 illustrate other conditions where an obstacle is present on the flat bed.

FIG. 7 illustrates a situation where the obstacle 48 is detected within the area of the print substrate 40 at a position which is just outside of the path of movement of the print head 24. The print head 24 makes a scan pass in the main scanning direction +x and just moves past the obstacle 48 without hitting it. In the next scan pass, however, the obstacle 48 would be hit, not necessarily by the guide rail 20, but by the print head 24. The time to collision will therefore depend upon the movement of the print head 24 in the main scanning direction. Again, a warning signal will be issued. The last time to safely stop the print head 24 without causing any artefacts in the printed image will be the time when the scan pass shown in FIG. 7 is completed and the print head stops and changes direction at the right end of the bed 12 in FIG. 7. The print head 24 and the scan movement of both the print head and the gantry will therefore be stopped at this point of time if, at the time when the obstacle 48 is detected, the time to collision is smaller than another threshold value corresponding to the time needed for completing the present scan pass plus the time needed for the next scan pass (or the next few scan passes if the print process is not to be stopped in the very last moment).

In the situation shown in FIG. 7, it would be possible to extend the time to collision by slowing down the movement of the print head 24 in the main scanning direction. This, however, would mean that different parts of the image would be printed at different carriage speeds which might give rise to artefacts in the printed image. It is therefore preferred not to change the speed of the carriage 22 in this situation.

Figure 8:
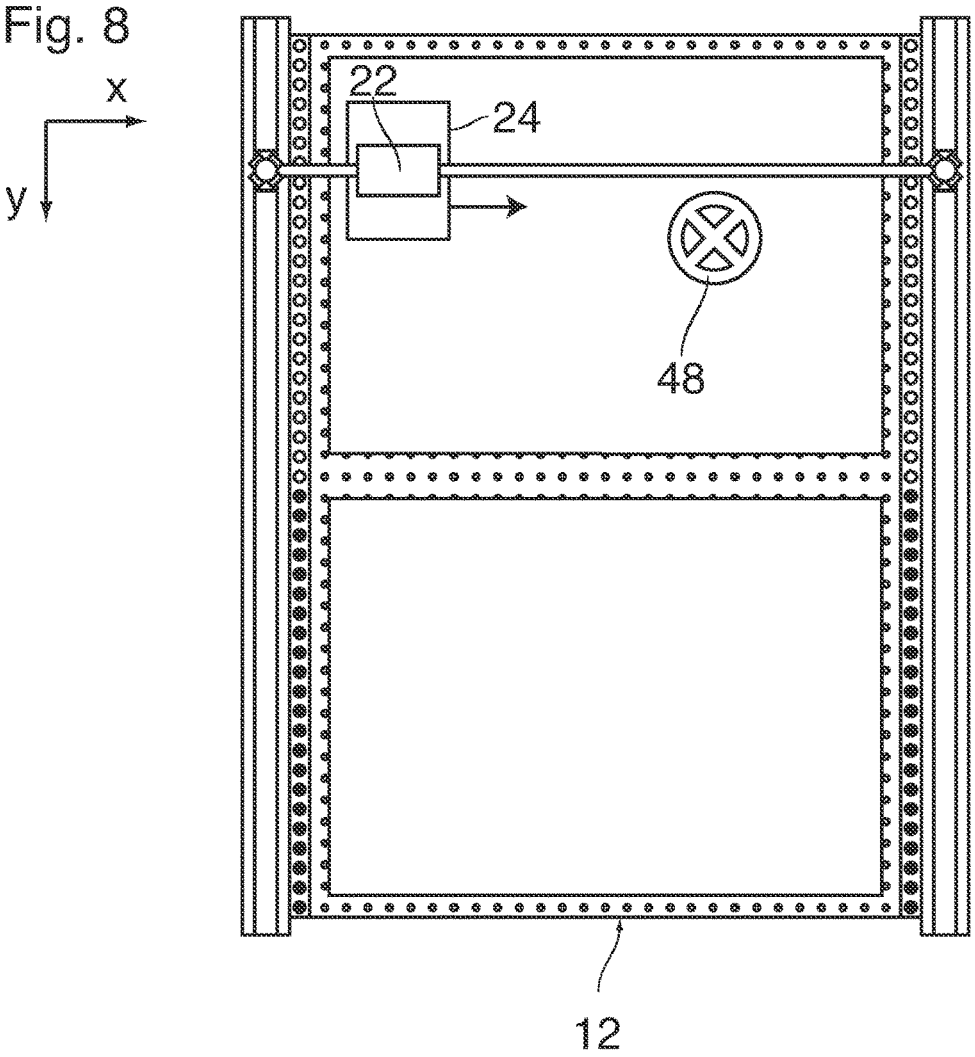

In contrast, FIG. 8 shows a situation where, at the time when the obstacle 48 is detected, the obstacle is already within the path of movement of the print head 24 in the same scan pass, so that the time to collision is smaller than a threshold value given by the time that is needed for making one complete scan pass. In that case, a collision can only be avoided by causing the print head carriage 22 to make an emergency stop so as to halt the print process as soon as possible and in any case before the obstacle 48 is hit.

Figure 9:
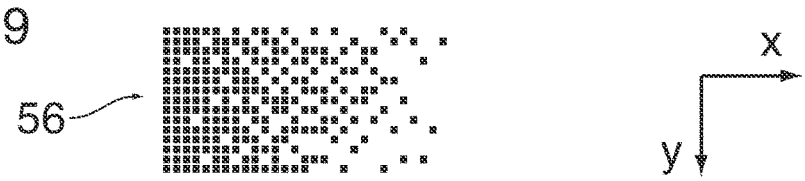
FIG. 9 illustrates an example of a fade-out mask to be applied in order to prepare for an emergency stop of a print head.
Figure 10:
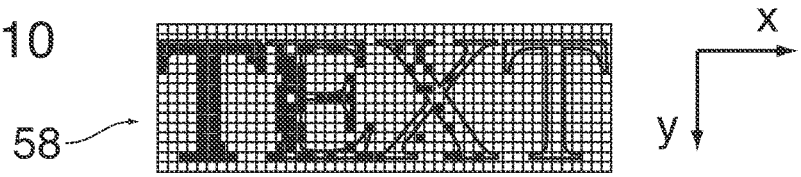
FIG. 10 is an example of a part of a printed image printed with the mask shown in FIG. 9.

FIGS. 9 and 10 illustrate a strategy for avoiding the creation of artefacts in the printer image in this situation.

To that end, the controller 30 stores a fade-out mask 56 which has been shown symbolically in FIG. 9. What is shown in FIG. 9 is a pixel pattern for a swath of the image to be printed in one scan pass. Consequently, the mask has a width corresponding to the width of the printed swath (e.g. the width of the print head 24) in the sub-scanning direction, and it has a certain length in the main scanning direction x. Black dots in FIG. 9 indicate pixel positions where a pixel is allowed to be printed, and the white gaps between the dots indicated pixel positions where printing of a pixel is inhibited. It can be seen that the density of black dots gradually increases from 100% to 0% in the main scanning direction x.

When an emergency stop has to be made, the bitmap that defines the image to be printed will be combined with the fade-out mask 56 by an OR conjunction, with the result that the printed swath of the image is gradually faded out, as has been shown in FIG. 10 where an image 58 to be printed consists of the word "TEXT". It can be seen that the density of the black parts of the image gradually decreases from left to right in FIG. 10 which means that the image is gradually faded out. While the image 58, which has the length of the fade-out mask 56 in the main scanning direction, is being printed, the speed of the print head carriage 22 is kept constant, so that no artefacts are created by varying the carriage speed. The carriage will be slowed-down and brought to a stop only after the faded-out process is completed and the density has decreased to zero (which means that no pixels are printed any more.

Then, when the obstacle has been removed, the print process may be resumed by scanning the area of the image 58 once again, this time, however, with using a fade-in mask (not shown) which is complementary to the mask 56 shown in FIG. 9, so that the missing pixels will be inserted into the image 58. Consequently, parts of the image 58 that have been printed before the interruption of the print process will be blended gradually with other parts which are printed after the interruption.

The transition between the image parts printed before and after the interruption may be made smoother by increasing the length of the fade-out mask 56, provided of course that the remaining time to collision is still large enough to permit the carriage 22 to be stopped in time. It is therefore preferred that the controller 26 stores fade-out masks of different length and selects the mask to be applied dependent upon the available time to collision.

The invention claimed is:

1. A flat bed printer comprising:

a flat bed;

a print head assembly;

a drive system arranged to move the print head assembly over the bed;

a controller arranged to control operations of the print head assembly and the drive system; and an obstacle detection system arranged to detect obstacles in a region of movement of the print head assembly, wherein the controller has a split-bed mode of operation in which the movements of the print head assembly are confined to only a part of the bed while another part of the bed is left idle, and the controller is arranged to calculate, when an obstacle is detected in the split-bed mode of operation, an expected time to collision after which the print head assembly will collide with the obstacle, wherein the print head assembly comprises a gantry movable in a sub-scanning direction, and a print head movable along the gantry in a main scanning direction orthogonal to the sub-scanning direction, and wherein the controller is arranged to calculate a first time to collision after which the gantry is expected to collide with the obstacle, and a second time to collision, after which the print head is expected to collide with the obstacle, and to decide on an action to be taken in order to avert the collision on the basis of the smaller of the two times to collision.

2. The printer according to claim 1, wherein the controller is arranged to issue a warning signal when the expected time to collision is smaller than a predetermined warning-signal threshold value.

3. The printer according to claim 1, wherein the controller is arranged to slow-down the movement of the print head assembly when the expected time to collision is smaller than a predetermined slow-down threshold value.

4. The printer according to claim 1, wherein the controller is arranged to stop the print operation when the expected time to collision is smaller than a predetermined stop threshold value.

5. The printer according to claim 1, wherein the controller is arranged to slow-down the movement of the gantry in the direction towards the obstacle when the expected time to collision is smaller than a predetermined slow-down threshold value.

6. The printer according to claim 5, wherein the controller is arranged to move the gantry in the sub-scanning direction step-wise and to slow-down this movement by reducing a distance which the gantry travels in each step.

7. The printer according to claim 1, wherein the controller is arranged to stop the print process at the end of a scan pass of the print head in the main scanning direction when the expected time to collision is smaller than the time needed for completing the current scan pass plus the time needed for making a given member of further scan passes.

8. The printer according to claim 1, wherein the controller is arranged to stop the print process before a scan pass has been completed, if the expected time to collision is smaller than the time needed for completing the scan pass.

9. The printer according to claim 8, wherein the controller is arranged to gradually fade-out a printed image before reducing a speed of travel of the print head in the main scanning direction when the print process is to be stopped before the present scan pass is completed, and the controller is further arranged to resume printing by scanning the image, which had been faded-out, once again and thereby fading-in a missing part of the image.

10. A method of printing with a flat bed printer which comprises a flat bed, a print head assembly, a drive system arranged to move the print head assembly over the bed, a controller arranged to control operations of the print head assembly and the drive system, and an obstacle detection system arranged to detect obstacles in a region of movement of the print head assembly, the method comprising the steps of:

defining an active part of the flat bed and confining the movement of the print head assembly to that active part, when an obstacle is detected within the active part of the bed, calculating an expected time to collision after which the print head assembly will collide with the obstacle; and deciding on an action to be taken in order to avert the collision, the decision being dependent upon the calculated time to collision, wherein the print head assembly comprises a gantry movable in a sub-scanning direction, and a print head movable along the gantry in a main scanning direction orthogonal to the sub-scanning direction, and wherein the method further comprises the steps of:

calculating a first time to collision after which the gantry is expected to collide with the obstacle, and a second time to collision, after which the print head is expected to collide with the obstacle, and deciding on an action to be taken in order to avert the collision on the basis of the smaller of the two times to collision.

11. A software product comprising program code on a non-transitory machine-readable storage medium, the program code, when run on a controller of a flat bed printer, causing the controller to perform the method according to claim 10.

* * * * *